US006457332B1

(12) United States Patent
Schiavello

(10) Patent No.: US 6,457,332 B1
(45) Date of Patent: Oct. 1, 2002

(54) FOOTWEAR GARMENT, METHOD OF MANUFACTURE AND KNITTING MACHINE

(76) Inventor: Oreste Schiavello, 5 Valencia Street, Glen Roy Victoria (AU), 3046

( * ) Notice: Subject to any disclaimer, the term of this patent is extended or adjusted under 35 U.S.C. 154(b) by 0 days.

(21) Appl. No.: 09/787,856

(22) PCT Filed: Sep. 24, 1999

(86) PCT No.: PCT/AU99/00814

§ 371 (c)(1),
(2), (4) Date: May 8, 2001

(87) PCT Pub. No.: WO00/19846

PCT Pub. Date: Apr. 13, 2000

(30) Foreign Application Priority Data

Oct. 1, 1998 (AU) ..... 6282

(51) Int. Cl.[7] ..... D04B 9/56
(52) U.S. Cl. ..... 66/8; 66/186
(58) Field of Search ..... 66/182, 183, 184, 66/185, 186, 187, 194, 49, 8, 13, 223, 215; 2/239, 241

(56) References Cited

U.S. PATENT DOCUMENTS

| | | | | | |
|---|---|---|---|---|---|
| 1,727,586 | A | | 9/1929 | Condon | |
| 3,990,115 | A | | 11/1976 | Nester | 2/239 |
| 4,277,959 | A | * | 7/1981 | Throneburg | 66/185 |
| 5,428,975 | A | | 7/1995 | Lee, III et al. | 66/178 |
| 5,440,901 | A | | 8/1995 | Seino et al. | 66/47 |
| 5,560,226 | A | * | 10/1996 | Throneburg | 66/185 |
| 5,603,232 | A | * | 2/1997 | Throneburg | 66/185 |
| 5,791,163 | A | * | 8/1998 | Throneburg | 66/185 |
| 6,173,589 | B1 | * | 1/2001 | Hayes, Jr. et al. | 66/185 |
| 6,230,525 | B1 | * | 5/2001 | Dunlap | 66/182 |

FOREIGN PATENT DOCUMENTS

| | | |
|---|---|---|
| EP | 0082988 | 7/1983 |
| EP | 0632972 | 1/1995 |

* cited by examiner

*Primary Examiner*—Danny Worrell
(74) *Attorney, Agent, or Firm*—Andrus, Sceales, Starke & Sawall, LLP

(57) ABSTRACT

A sock type garment adapted for wearing on a wearer foot including a sole (3), partial upper foot (5), a heel (8, 9) and a toe (11, 12) wherein said heel and toe are shaped to assist accommodation of the respective parts of the wearers foot characterised in that an opening (4) for insertion of the wearers foot is provided intermediate of said heel and toe in the region of the partial upper foot.

19 Claims, 9 Drawing Sheets

FIG. 4.
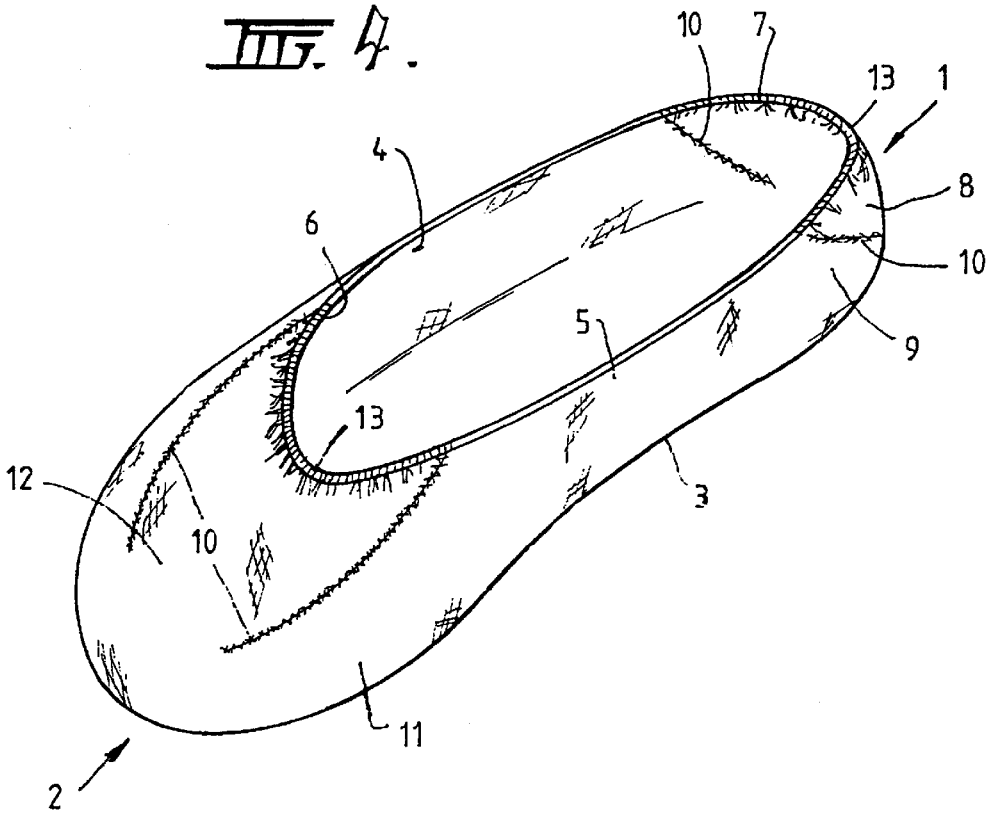
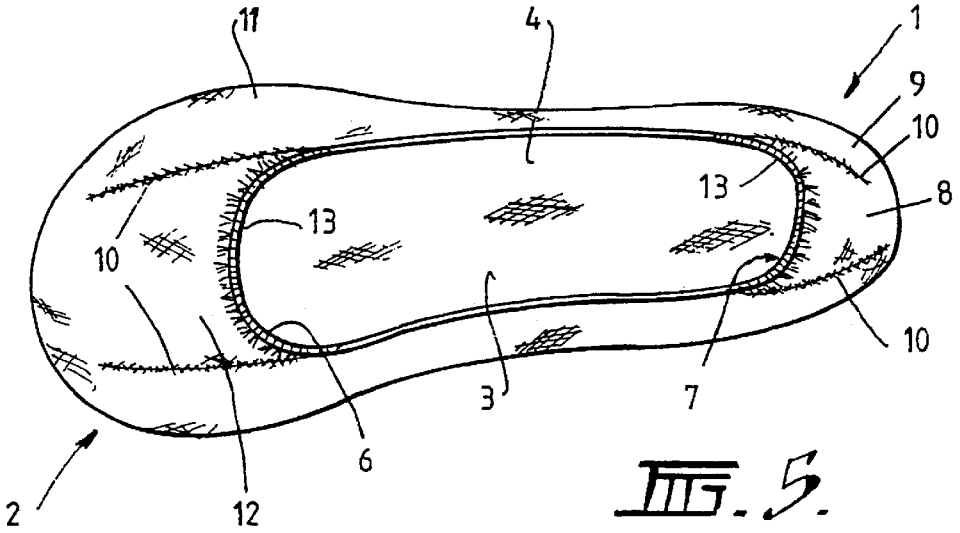
FIG. 5.

40
23
34
34
29
23
27
22
21
16
16
31
11
11
20
21
12
21
20
37
29
26
30
35
36
25
31
12

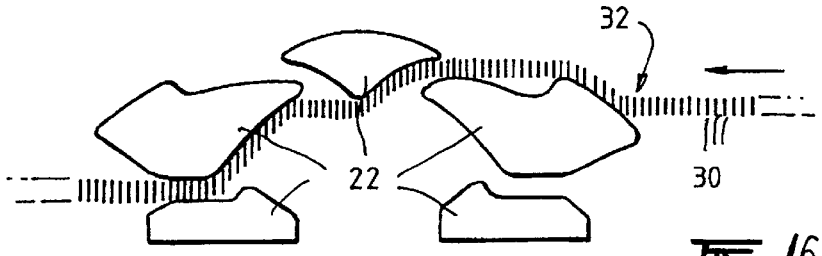
FIG. 16.
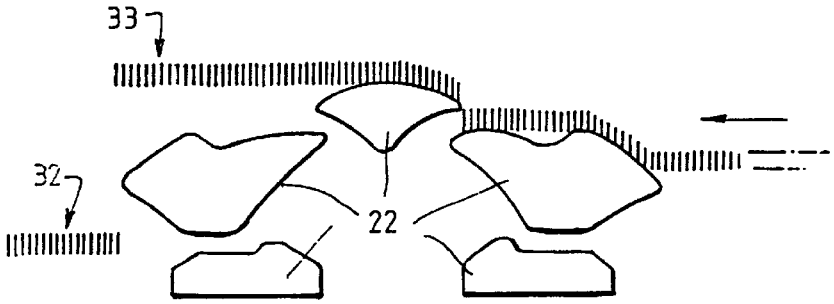
FIG. 17.
FIG. 18.
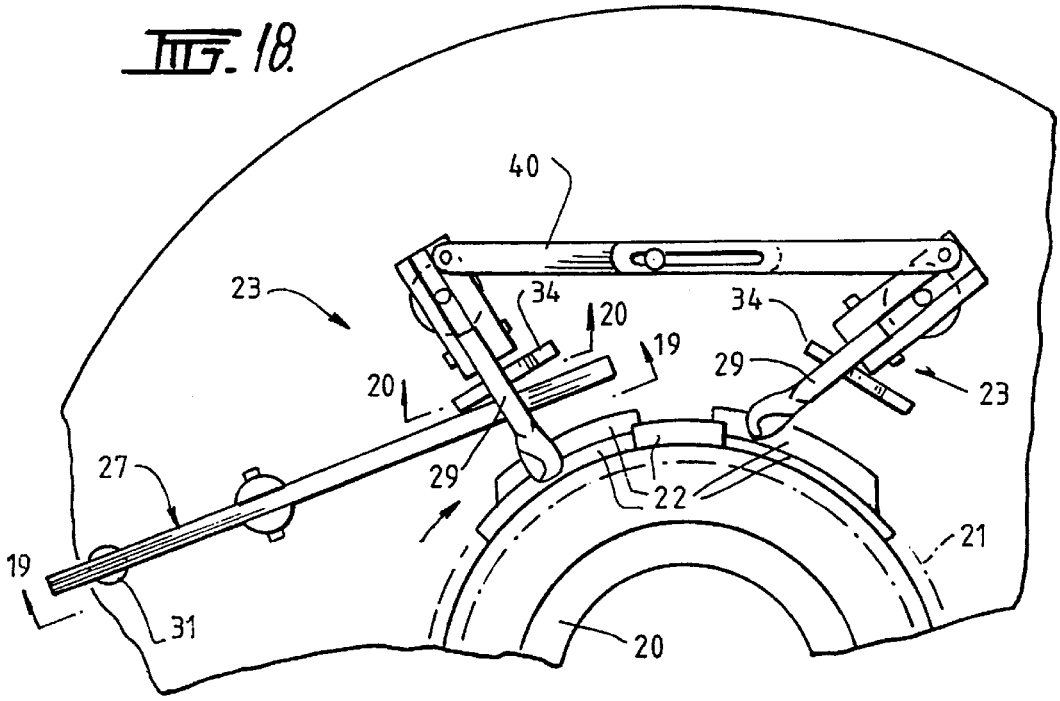

FOOTWEAR GARMENT, METHOD OF MANUFACTURE AND KNITTING MACHINE

CROSS REFERENCE TO RELATED APPLICATION

The present application is the U.S. National Stage Application of International Application PCT/AU99/00814, filed Sep. 24, 1999, which international application was published on Apr. 13, 2000 as International Publication WO 00/19846 in the English language. The International Application claims priority of Australian Application PP6282, filed Oct. 1, 1998.

BACKGROUND OF THE INVENTION

This invention relates to hosiery, socks and similar garments and in particular relates to an improved footlet type sock adapted for concealment by a wearer's footwear during use. The invention also relates to an improved knitting machine, method of operation and method of manufacture of said garment Discreet footwear garments, where a small sock or stocking covering only the wearer's foot region below the ankle, have become popular fashion accessories which allow a wearer to enjoy the benefits of foot protection but which become fully concealed once the wearer fits shoes or other footwear.

To date, such garments, known as footlets or socklets have been developed from sheer hosiery technology where the substantial flexibility of the medium allows a very generic or unshaped unit to fit all feet. Such items have been manufactured to date from the provision of an initial pattern or garment blank in the form of a short "tube" of sheer hosiery material which is closed at the bottom with a seam and provided with an elastic welt at the top to form an opening. In use, such garments are fitted by placing the user's foot into the opening and pulling the unshaped garment over the foot so as to conform to the shape of the wearer's foot by stretching. Such prior art garments suffer from numerous problems, in particular the bottom seam can be an irritation to the wearer and the lack of preshaping of the garment provides a less than ideal fit to any given wearer. Furthermore, such garments are exposed to high levels of material stress at the toe regions where the greatest elasticity and stretch occur.

In another form, similar prior art garments have been developed without a lower seam by providing an oval-shaped flat garment blank which has sowing fitted to its circumference causing the garment to pucker and draw up into a general shower cap shape. Whilst this method of manufacture provides a seamless garment which some advantages, the garment is still not shaped to conform in any way to the user's foot and requires considerable stretching to fit with the resultant stresses and limited durability associated with the previously discussed garments.

In addition to the above limitations the currently available garments must, by necessity, be made of highly compliant materials to allow the user's foot to stretch the garment into the correct shape. Accordingly, such garments are only made in a limited range of materials and the full potential of the garment has not been explored to date.

SUMMARY OF THE INVENTION

Accordingly, in one aspect the invention provides a sock type garment adapted for wearing on a wearer's foot including a sole, a heel and a toe wherein said heel and toe are shaped to assist accommodation of the respective parts of the wearer's foot characterised in that an opening for insertion of the wearer's foot is provided intermediate of said heel and toe.

The regions of the heel and toe may be shaped into pockets. The garment may have a partial upper foot adjacent said sole.

The opening is preferably formed across the heel top, toe top and partial upper foot of said garment.

The opening may have a knitted hem or elastic means fitted to said heel top and said toe top to assist snug fitting of garment and finish off the heel top and toe top region. The heel may include a heel one section formed by a picking up stitch and a heel two section formed by alternate picking up and picking down stitch with the heel one and heel two section being seamlessly and continuously joined and separated by a picking line so formed.

The sole of the garment may be formed as a knitted continuum of the heel and leading to a knitted continuum with the toe.

The toe may include a toe one section formed by a picking up stitch and a toe two section formed by alternate picking up and picking down stitch with the toe one and toe two sections being seamlessly and continuously joined and separated by a picking line so formed.

The heel one section may be of sufficient size to substantially cover the wearer's heel and the toe one section may be any size from a partial toe covering to a cover for the bulk of the wearer's upper foot.

The garment may be constructed of a wide range of stitch form materials including hosiery materials used in the manufacture of stockings and pantyhose and/or knitting yarns, wool, cotton, nylon and any materials available for sock manufacture.

In another aspect, the invention provides a method of manufacturing a sock type garment including a sole, a heel and a toe region with an intermediate opening between said heel and toe region bordered by the top of the sole or partial upper foot and the heel top and toe top; the method including the use of a knitting machine to form the heel region of said garment beginning with the formation of the heel one section by pick up stitching then transferring to heel two section by alternate pick up and pick down stitching, the sole of the garment and partial upper foot are then formed followed by alternate pick up and pick down stitching to form the toe two section then transferring to the toe one section by pick up stitching only. The garment may be finished by a knitted and shaped elastic edge or ridge over the heel top, toe top and the top of the sole or upper foot. The elastic ridge may be formed with transfer needle selection only to achieve the elastic ridge. The machine dial transfer need not be used.

The sock type garment can alternatively be manufactured beginning at the toe region and moving to the heel region.

The method of manufacture may begin with the preparation of an elastic braid forming the toe top. The toe one part of the garment is formed with the knitting machine back pickers in action and by selective cancellation thereof so as to form the required number of pick up stitches with a progressive decrease taking one needle per side off every second course. When the toe one is completed the knitting machine front pickers come into action selectively returning needles held in memory, so called pick down stitches, providing an alternate preparation of stitching progressively adding courses until the toe region is formed. The unique ability to progressively control the back and front pickers by cancellation allows the method of manufacture to produce a fully formed one piece seamless garment without interruption in one continuous operation. Once the toe region is formed the pickers can be cancelled without interference to the pre-programmning of the needles and the partial upper foot and sole of the garment can be formed as a direct continuation of the toe region. The foot region can be made as long as required then the heel region is ready to be formed. The back pickers are bought into action to selectively place needles into memory, so called pick up stitches, providing a series of stitches with a progressive drop in stitches toward the heel, the front picker then begins to add on stitches to form progressive pickup stitching so as to form a seamless heel region. The heel is then completed by forming an elastic ridge.

In another aspect the invention provides a modified knitting machine including a mounted rotatable cylinder having a series of closely spaced needles located in annular slots said machine being provided with needle operating cams, two back pickers for placing selected needles into memory and at least one front picker for returning needles from memory characterised in having cancellation means to selectively cancel the function of said back picker and/or said front picker within a given cycle.

The back pickers may be provided in left or right configuration to cooperate with the alternate counter clockwise and clockwise rotation of said cylinder. The back cancellation means may act on either or both back pickers and preferably acts in lifting the picker needle arm away from interaction with said needle. The front cancellation means may act by lowering the picker needle arm away from interaction with said needle.

The cancellation means may be activated by a programmable switching means which comprises microswitches operable from a cam or other means. The microswitches, or a mechanical equivalent, activate air cylinders or the like which cooperate with a mechanical means to operate the cancellation means. The inclusion of such a cancellation means allows the pre-programmed operation of the back and front pickers to be interrupted at will without interfering with the needles. In this manner a selected number of needles can be held in memory for instant recall without interfering with the knitting thereby providing greatly extended modes of operation of a knitting machine. In order to assist the continuous operation of the machine the cylinder 20 is provided with a number of "dummy" needles being non functioning needles placed into the cylinder but which have been modified by removal of the hook end thereof.

The modified knitting machine is particularly adapted for manufacture of the improved footwear garment as described and claimed in the current application. In particular the modified machine allows the production of a seamless garment moving from a fully formed toe region to an extended seamless sole and partial upper foot and then into a fully formed heel region in one continuous operation.

BRIEF DESCRIPTION OF THE DRAWINGS

The invention will be further described by reference to FIGS. 1 to 21 with:

FIG. 4 shows a perspective view of the garment of the invention.

FIG. 5 shows a plan view of the garment of the invention.

FIG. 16 shows the needle butt path following the needle operating cams when in normal knitting pattern (in direction of arrow 16—16 FIG. 10).

FIG. 17 shows the needle butt path partially following the needle operating cams with some needles held in memory.

FIG. 18 shows a plan view of the back pickers in reverse orientation when knitting back rows.

DETAILED DESCRIPTION OF THE PREFERRED EMBODIMENTS

Figures 1, 2, 3:
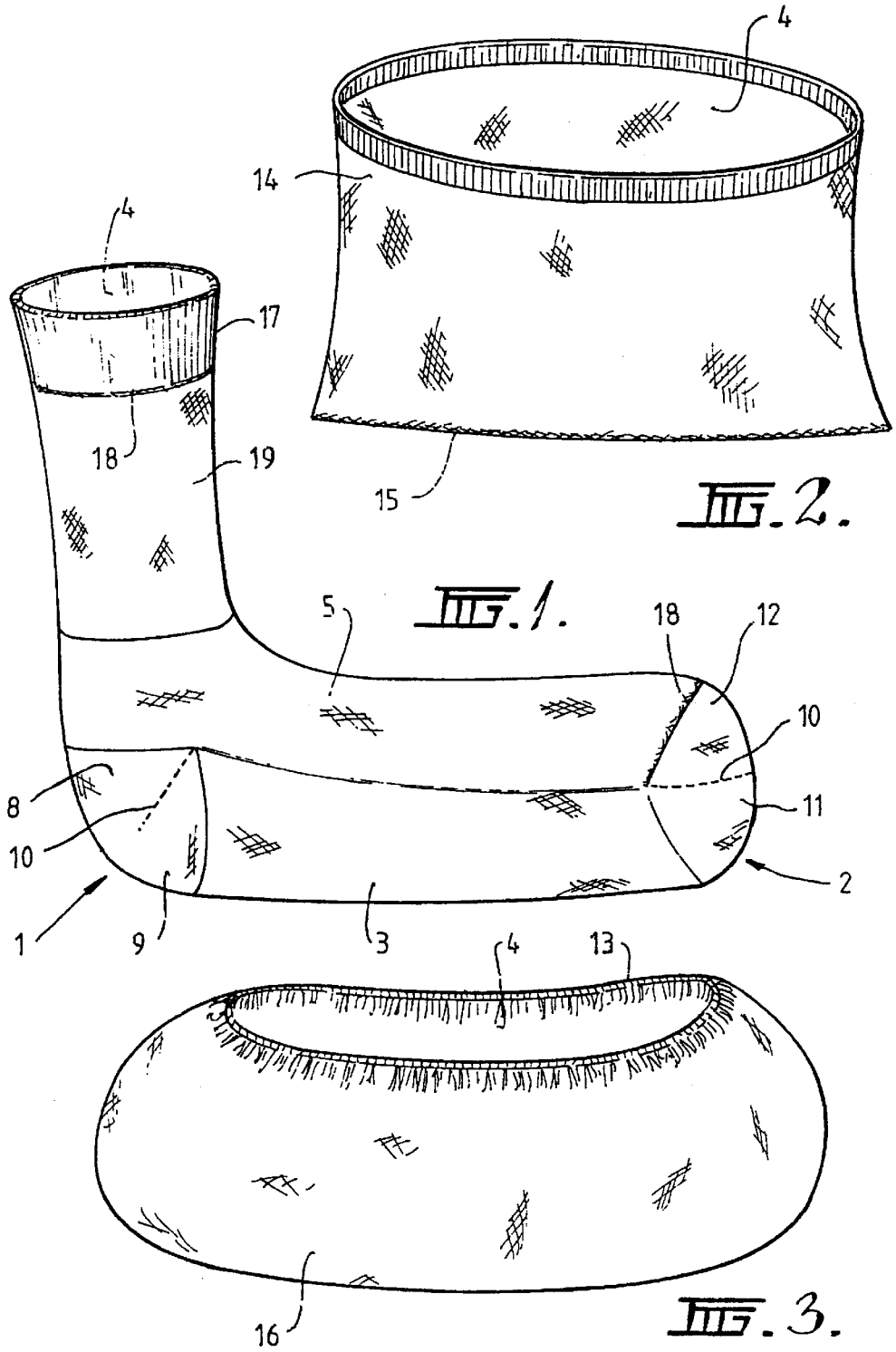
FIG. 1 shows a prior art conventional sock.
FIG. 2 shows a prior art footlet having a seamed sole.
FIG. 3 shows a seamless prior art footlet

Referring firstly to FIG. 1, an overview of the construction of a prior art generic sock is shown where the sock comprises an opening 4 at the top for insertion of a wearer's foot, followed by a welt region 17 providing elasticity and grip to the leg of the wearer. The welt is terminated by a transfer band 18 which defines the boundary with the top leg region 19 followed by the leg region. The heel region begins with the high heel region just before the formation of the heel pocket and body of the sock. The heel pocket is made up of various sections including the heel one section 8 which is constructed by pick up stitching only. The heel one section 8 transfers continuously into the heel two section 9 by alteration of the stitching to a pick up and pick down stitching and the transition zone creates what is known as a "picking line" 10. Once the heel pocket 1, being made up of the heel one and heel two sections has been formed, the stitching continues along to the sole 3 with an upper foot region 5 being formed as a continuation of the high heel and adjacent the sole 3. The terminal end of the sock forms the toe pocket 2 which is made up of a toe one section 11 formed by pick up stitching only which transfers into a toe two section 12 being formed by the alternate pick up and pick down stitching with the transitional picking line 10 being formed.

In the manufacture of a standard sock, the toe region is initially formed on the knitting machine as an open construction with the upper foot and sole regions meeting the ring toe section and toe one, toe two sections respectively where the ring toe and toe two section is terminated by a linking stitch and finished off with a run out stitch. The final step in manufacture of the sock involves the placement of the run out in a dedicated seaming machine which effects the sowing up or seaming of the linking region along the toe pocket and the cutting off of the run out. This step finalises the formation of the toe pocket 2 by the formation of a ring toe seam 18. The manufacture of socks in this manner is well known to the art and accomplished by a wide range of readily available knitting machines which can make use of a wide range of fabrics and materials in the preparation and manufacture of socks.

The invention relates in particular to a smaller version of a sock known as a footlet or socklet which are intended to cover just the foot region of a wearer's anatomy without involving any cover of the leg so as to provide a foot garment that can be totally disguised when the wearer places on shoes or other footwear.

The currently available garments of this type are shown in FIGS. 2 and 3. Referring to FIG. 2, one of the prior art garments can be seen to be constructed of a continuous tubing of hosiery 14 which is sealed off at the bottom with a seaming sole 15 and provided with an elasticised opening 4. As previously discussed, such prior art garments are not shaped in any manner and rely on the high stretching and elasticity of hosiery fabric for a wearer's foot to be inserted in the opening so as to substantially deform the garment and fit onto the wearer's foot. It would not be possible to manufacture such a garment from conventional sock materials like wool or cotton as these materials do not provide sufficient elasticity.

Referring to FIG. 3, an alternative prior art garment is formed by creating a cut-out blank of oval or circular formation which is gathered around its periphery by an elastic means 13 which is tensioned so as to draw up or pucker the whole construction into a seamless body 16 providing an opening 4. This prior art garment provides some improvement on the previously described prior art garment but still does not provide any pre-shaping in accordance with the wearer's foot and suffers from many of the difficulties of the previously described prior art garment.

Referring now to FIG. 4, one aspect of the invention is shown in a perspective view and the garment can be seen to comprise a fully and carefully shaped footlet sock or miniature sock which is adapted for wearing on a wearer's foot and includes a sole 3 forming a substantial part of the base of the garment. A shaped heel 1 and a shaped toe 2 are provided at either end and an opening 4 intermediate of the heel and toe such that the user's foot can be readily inserted into the opening into the substantially preformed and shaped toe pocket and heel region in a manner that allows the garment to immediately and snugly fit to the user's foot.

The garment of the invention may further be provided with a partial upper foot region 5 which is not fully closed over in the manner of a conventional sock in order to protect the side of the wearer's foot. The opening 4 is formed across the heel top 7 and toe top 6 and the partial upper foot 5. The opening may be provided with elastic means 13, particularly across the toe top region 6 and the heel top region 7 in order to assist the shaping of the garment to create a very snug and conformational fit to a wearer's foot. The elastic means is formed as an integral part of the garment during the knitting operation and is tapered to nothing as the top region 6 of the toe or heel migrates into the partial upper foot 5. The garment of the invention is formed with the use of standard knitting machines which may be suitably modified in accordance with the current invention and comprises many of the anatomical features of a standard sock, albeit in a highly novel configuration. The heel pocket 1 is shaped by the provision of a heel one section 8 which is formed by a picking up stitch only; the heel one section seamlessly moves into the heel two section 9 by the alteration of the stitching to include alternate picking up and picking down stitches, resulting in the formation of the picking line 10 and causing the garment to fold around to form the heel pocket 1. Similarly, the toe two can be formed as a pocket shaped unit 2 with a toe one section 12 formed by a picking up stitch only which translates into a toe two section 11 by the alteration of the stitching to alternate picking up and picking down stitch and the resultant picking line 10. In this manner, the two sections of the heel and toe and the foot are formed seamlessly and continuously in one piece.

Referring now to FIG. 5, a plan view of the garment of the invention is shown where the particular features of shaping of the unit are clearly evident with the heel pocket 1 shaped to accommodate the heel of the wearer with the added provision of elastic 13 across the heel top 7. The heel one section 8 can be seen to form the upper region of the heel with the heel two section 9 forming the sides and lower part of the heel which is formed continuously with the sole 3. The toe pocket 2 is similarly shaped and more elongate than the heel pocket 1 and is formed of the toe one section 12 forming the upper or covering component of the garment terminating in the toe top 6 with the sides and lower part of the toe being formed from the toe two section 11. Similarly, the toe two section 11 merges with the sole 3 so as to form a completely seamless but carefully crafted and shaped one piece garment without any joints for fitting to a user's foot of any size.

Figure 6:
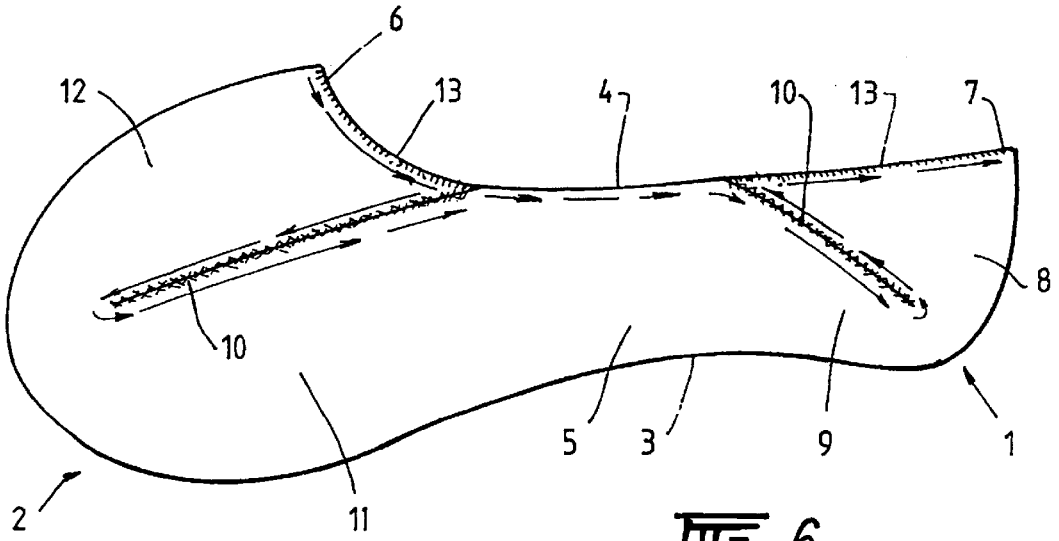
FIG. 6 shows a side view of the garment of the invention.
Figure 7:
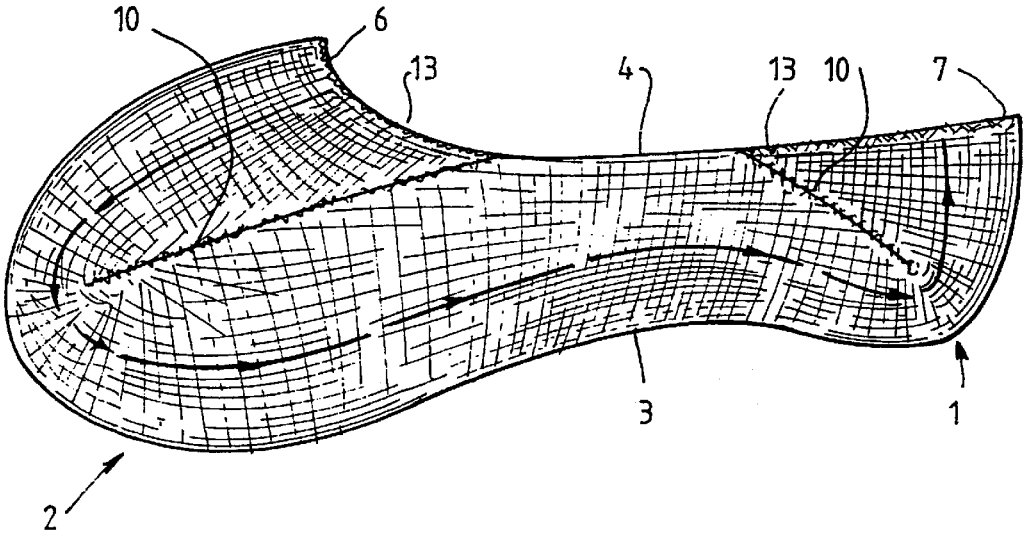
FIG. 7 shows a side view indicating a preferred stitch pattern.

The size of the toe one section 12 can be varied to accommodate different types of garments, either for covering just the toes of a wearer or can be extended to move further up the garment to cover a larger part of the upper foot of the wearer. The elasticised reinforced toe top 6 and heel top 7 is a preferred feature only as the substantial shaping and conformation of the garment per se, provides ready fitting and snug engagement of a user's foot; however, the elastic 13 at the toe top and heel top region can assist in maintaining a snug fit The elastic is most preferably not carried forth along the partial upper foot 5 as it is not necessary to have any elasticised fitting on this region, being the side of a user's foot Furthermore, such elastic in that region may be an irritation to the wearer. The method of manufacture allows the foot region to be formed of any length to provide a range of garment sizes. FIG. 6 shows a side view of the garment and FIG. 7 shows the preferred stitch pattern of the garment. The method of manufacture also allows for the tapering of the elastic region 13 which reduces to zero along the upper foot.

Figure 9:
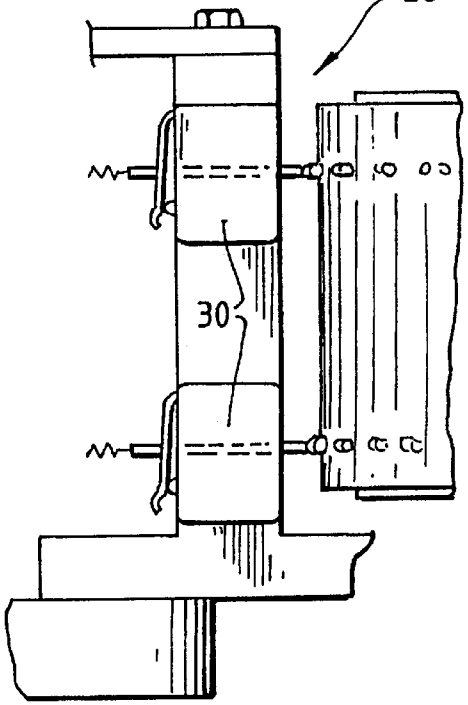
FIG. 9 shows a side view (section 9—9 FIG. 8) of the cancellation switching means.
Figure 8:
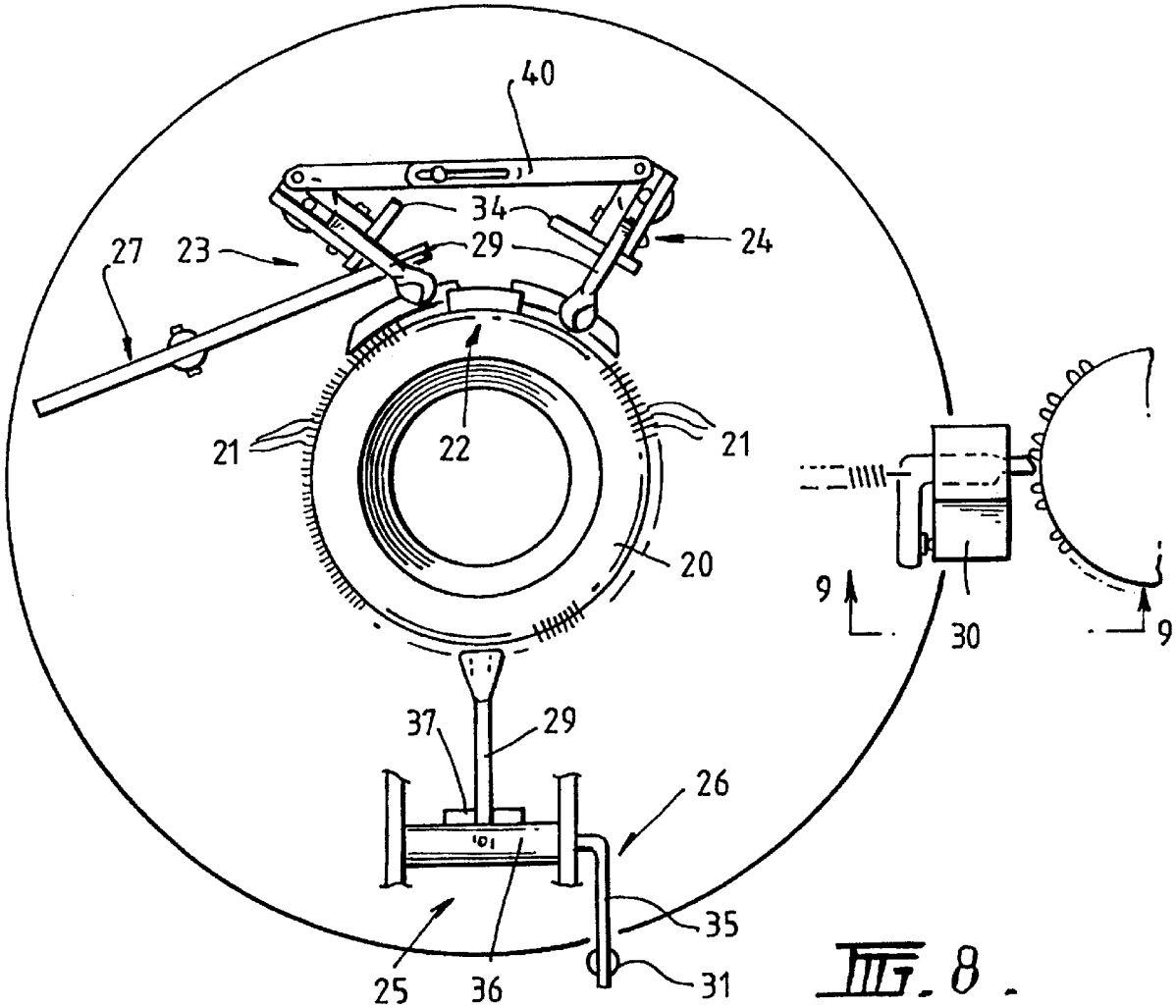
FIG. 8 shows a schematic plan view of a modified knitting machine of the invention showing the front and back cancellation means and switching means.
Figures 10, 11:
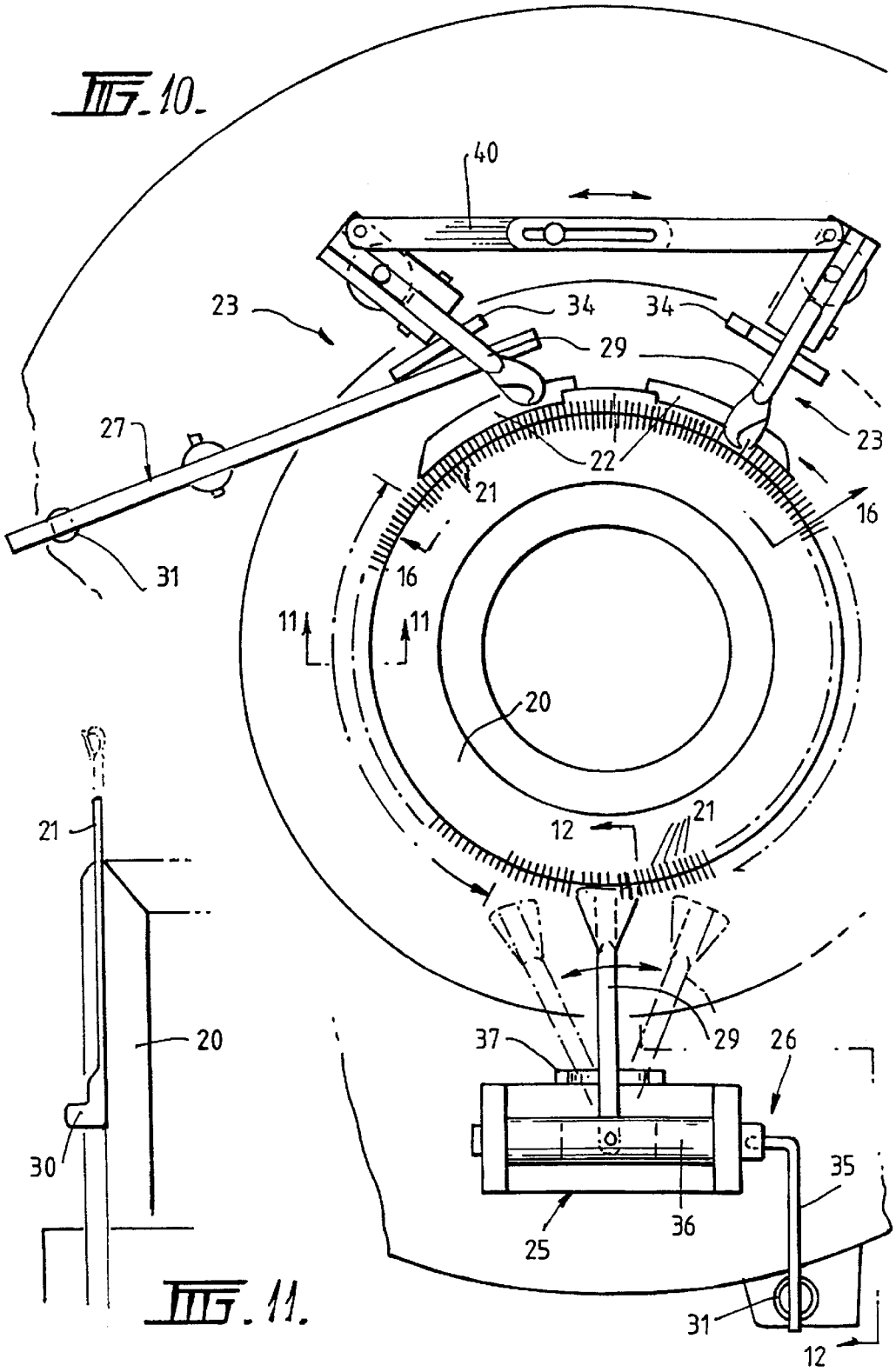
FIG. 10 shows an enlarged plan view of the modified knitting machine showing the cancellation means acting on the back and front picker mechanisms.
FIG. 11 shows a cross section (11—11 FIG. 10) of the machine cylinder with a needle that is positioned for non-use.

In another aspect the invention provides modifications to a standard knitting machine and a reference to the remaining FIGS. 8 to 21 provide details of a particularly preferred embodiment including modifications to a standard knitting machine and the performance thereof which provides for the first time, the ability to economically and efficiently exercise the method of the invention in the production of the improved footwear garment as previously described. Referring firstly to FIGS. 8, 9 and 10 plan and side views of the top region of the knitting machine as shown with FIGS. 8 and 10 providing schematic plan views of the automated knitting machine in question. Such automated knitting machines comprise a vertically mounted rotatable cylinder 20. The cylinder houses a plurality of closely spaced vertical needles 21 located in annular slots formed therein. Such machines function in a known manner by rotating the vertical cylinder in a clockwise and anti-clockwise cyclic fashion with the needles 21 being fed thread and activated by way of needle knitting cams 22 so as to effect standard knitting functions in the manufacture of socks and the like garments which are formed down the hollow centre of the cylinder 20 in the manner determined by the programming of the machine. Such machines are provided with two back pickers in the form of a left picker 23 and a right picker 24 which function to selectively lift up the needles 21 into a non operating or memory mode. The left and right pickers include picker needle arm 29A which operate alternatively to act on the needles 21 when the cylinder is rotating in the clockwise and anti-clockwise direction respectively. In addition, standard knitting machines are provided with at least one front picker 25 which is adapted for returning needles that have been placed in memory back into action. The picker needle arm 29A operates as a single picker arm functioning in both clockwise and anti-clockwise motions of the cylinder. The standard operation of a knitting machine allows for the action of the picker arms and needle knitting cams in a preset function but does not allow for the in mode alteration and intermittent cancellation of the functions of the back and front picker mechanisms. This limitation to standard knitting machines imposes limitations on the ability of such machines to manufacture garments incorporating various features such as a seamless continuum and in particular the ability of selectively alter the knitting functions mid cycle without interrupting the machines continuous operation. The invention provides cancellation means for both back and front pickers with the back cancellation means 27 operating in conjunction with the left back picker 23 as a pivoting lever which works by lifting up the picker arm 29 away from interaction with the needles such that at any point in time the normal function of the back picker, which is to place a selection of needles 21 into memory can be cancelled without interruption to the normal functioning of the needle and by leaving the needles so selected in a position ready for operation. The front picker functions of the standard machine can similarly be cancelled by operation of the front cancellation means 26 such that the normal mode of action of the front picker which is to draw needles held in memory back into action can be cancelled such that selective needles can be retained in memory rather than drawn out of memory as is the usual function.

The back and front cancellation means are activated either electronically or mechanically by a cancellation switching means 28 which is shown in side view in FIG. 9. The cancellation switching means comprises a cam and electronically operated microswitchs 30 which are able to affect the operation, at will, of the cancellation means 27 and 26 by suitable programming. The cancellation switching means is of course fully programmable in accordance with the requirements of the operator and suitable programmning of the modified knitting machine provides a ready means of manufacture of the improved foot garment as previously described. The positioning of the needle as previously described is shown in FIG. 11.

Figure 13:
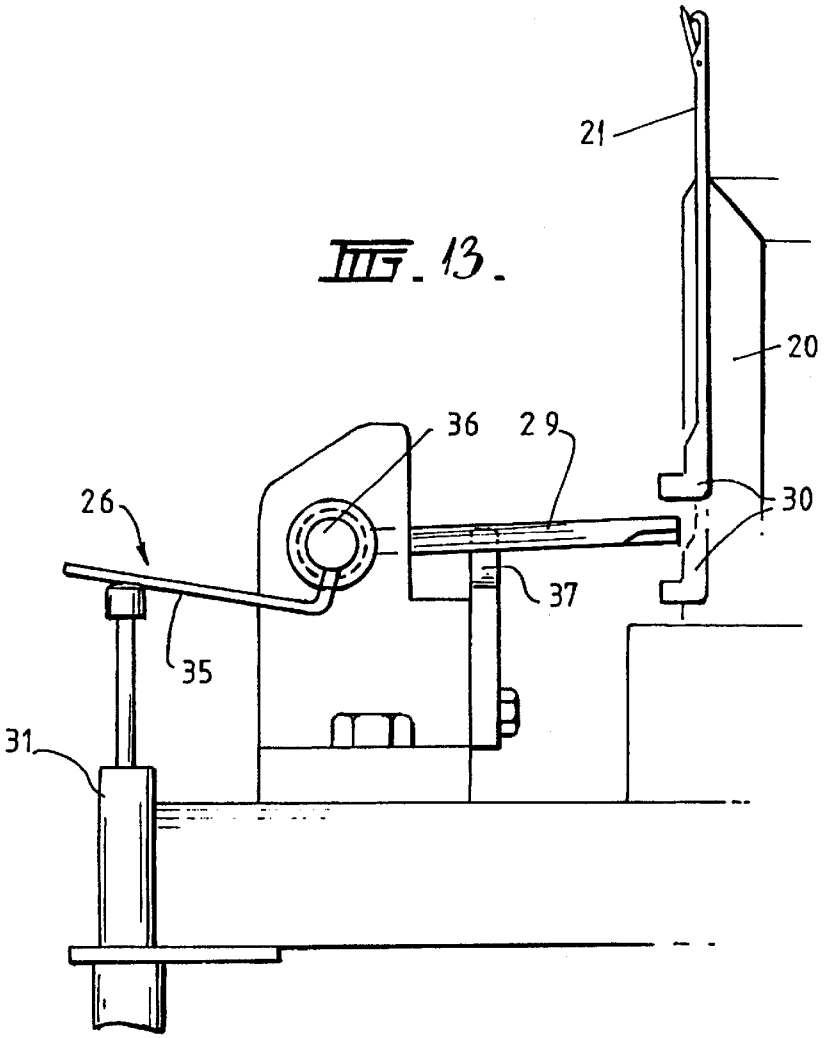
FIG. 13 shows the front picker mechanism with cancellation means functioning so as to prevent the front picker returning the needles from memory into action.
Figure 12:
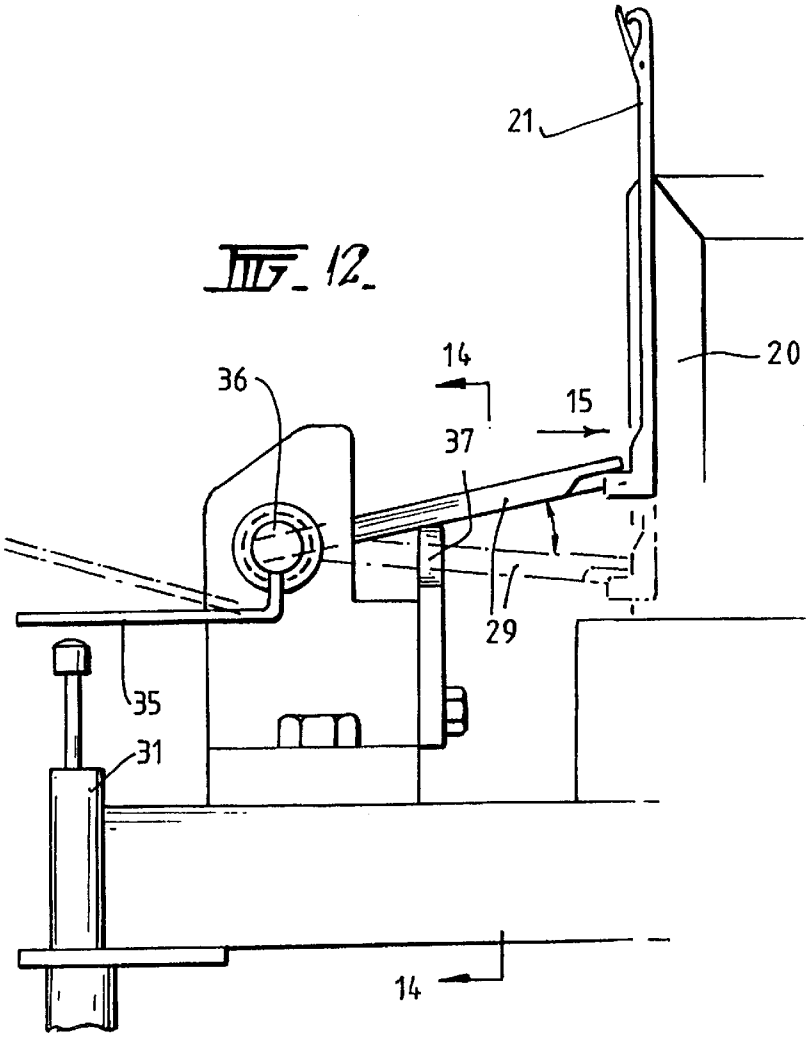
FIG. 12 shows a side view (in direction of arrow 12—12 FIG. 10) of the front picker mechanism with cancellation means not functioning (the front pickers normally return any needles from memory into action).
Figure 14:
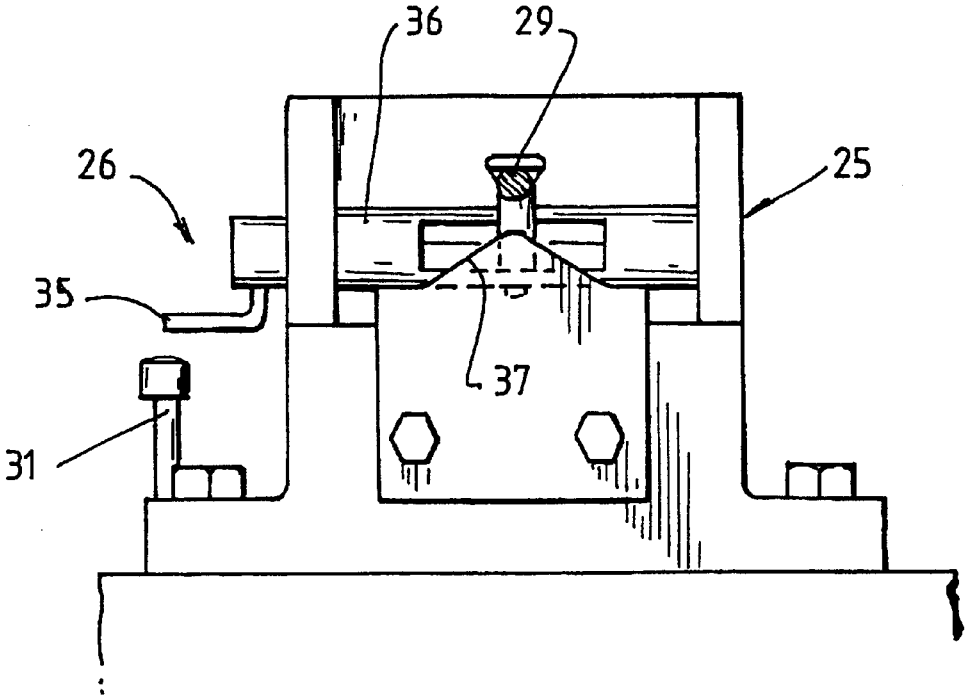
FIG. 14 shows a front view (in direction of arrow 14—14 FIG. 12) of the front picker mechanism with the cancellation means.
Figure 15:
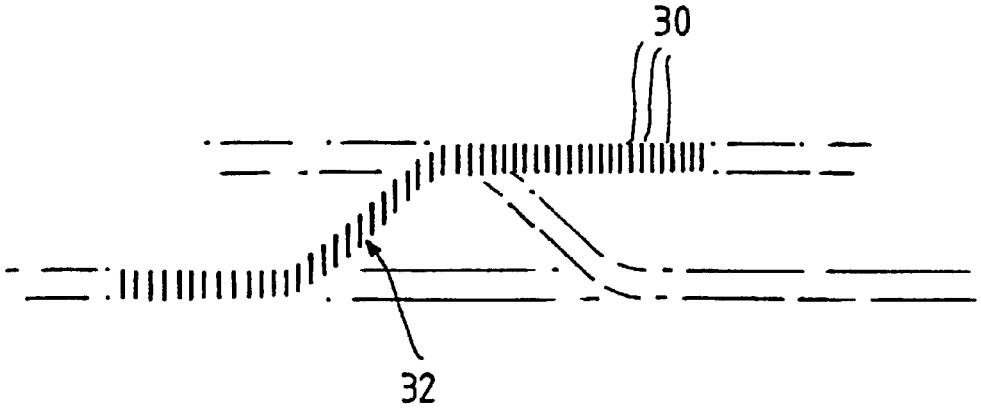
FIG. 15 shows a needle butt path when the front picker is functioning normally (in direction of arrow 15—15 FIG. 12).

Referring now to FIGS. 12 and 13, the operation of the front picker, and in particular, the cancellation means acting thereon, is shown in detail. As previously described the front picker provides a picker needle arm 29B adapted for cooperation with the butt ends 30 of needles, two at a time, as they are rotated past by the action of the cylinder 20. The normal function of the front picker is to collect needles that have been placed in memory, that is needles that have been elevated in the raised position as indicated. Such needles that are so positioned in the cylinder 20 as the cylinder rotates past the front picker are gathered by the elevated picker needle arm 29B. The picker needle arm 29B rests on a picker cam 37 which is shown in more detail in FIG. 14. As the needle 21 passes the front picker, the needle butts 30 of needles held in memory interact with the picker needle arm drawing the arm either left or right depending on the direction of rotation and in so doing, draw the needles out of memory as they are pulled down to the second position shown in phantom. The cancellation means 26 of the invention acting on the front picker takes the form of a lever 35 which is activated by an air cylinder 31. The lever 35 interacts with the picker needle arm axle 36 to suspend the picker needle arm 29B in a neutral position as shown in FIG. 13 when the front cancellation means is activated. FIG. 15 demonstrates a view of the needle butt path 32. The needle butt path 32 is shown in the direction of arrow 15—15 of FIG. 12.

Reverting now to the back cancellation means, FIGS. 16 and 17 show a view of the needle knitting cams 22 and the needle butt path 32 (33) as it passes through the knitting cams. FIG. 16 shows a schematic representation of the normal knitting pattern and FIG. 17 shows a schematic view of a needle pattern with the needle butt path drawn into memory 33 by the action of the back picker. The action of the back cancellation means can be seen where the needle butt path has reverted to the normal knitting pattern 32 in FIG. 17. In this manner the needle butt path placed in memory can be instantaneously drawn out of memory at will and in accordance with the programming of the cancellation switching means 28. Referring now to FIG. 18 a plan view is shown of the back picker mechanism where the left back picker 23 has been drawn into action for cooperation of the relevant picker needle arm 29 with the needles when the cylinder 20 is rotating in a clockwise direction. The left and right back pickers act alternately and are held in coordinated relationship by the tie rod 40.

Figure 19:
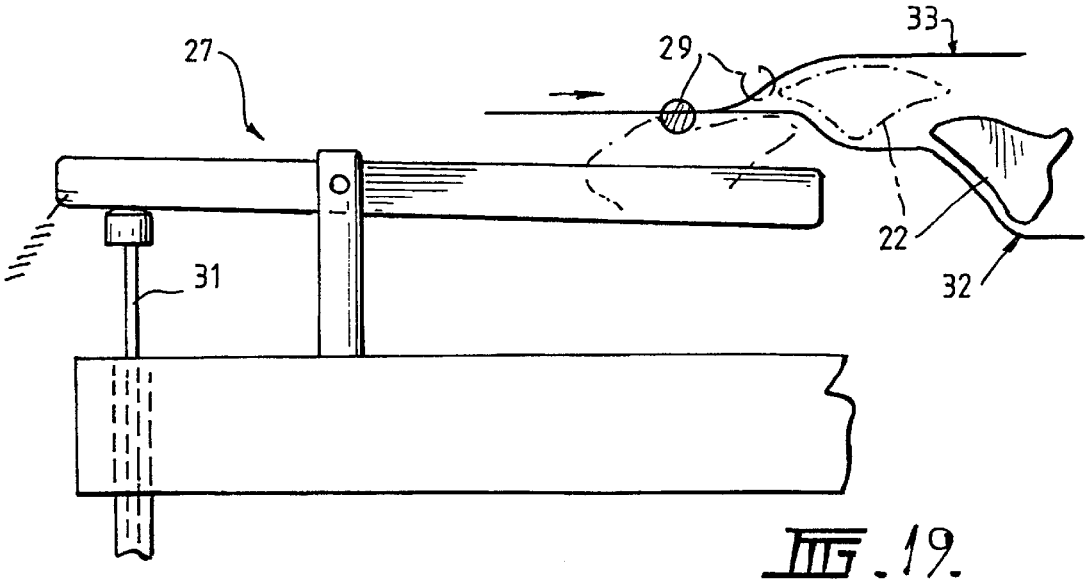
FIG. 19 shows a view of the cancellation means (in direction of arrow 19—19 FIG. 18) not in use and allowing a back picker needle arm to draw needles into memory.
Figure 21:
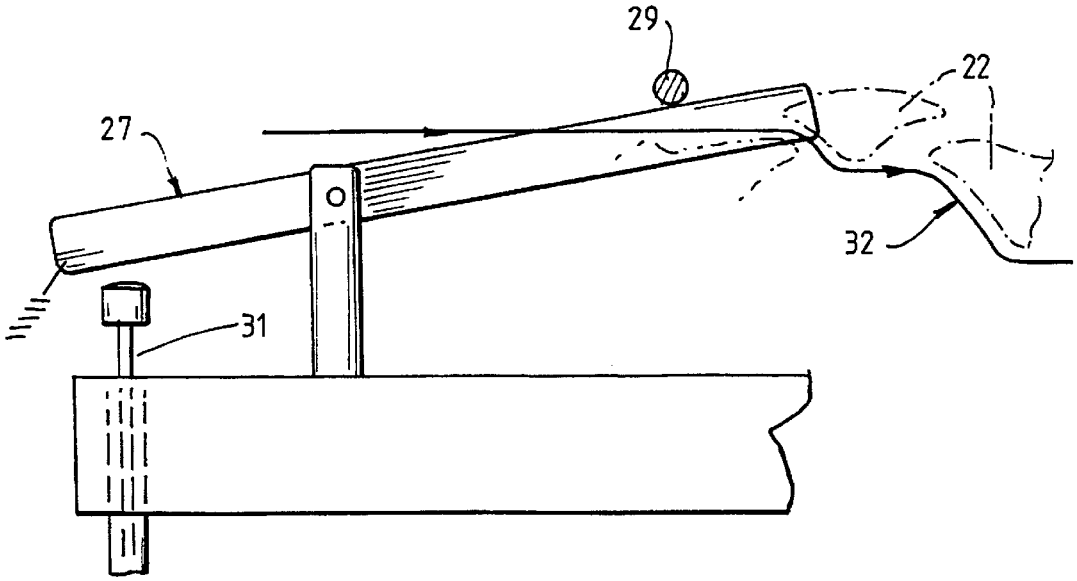
FIG. 21 shows the cancellation means when in use lifting as the back picker arm and allowing the needle butt path to resume normal knitting.

FIG. 19 shows a front view of the rear cancellation mechanism drawn in direction of arrow 19—19 of FIG. 18. The positioning of the needle operating cams 22 is shown with the alternate normal needle butt path 32 and needle butt path in memory 33 detailed. The position of the back picker needle arm 29A is shown. In this mode the back cancellation means 27 is inactive and is not cooperating with the back picker needle arm 29A which is left to function in the normal capacity dependant on the programming of the knitting machine. Referring now to FIG. 21 the back cancellation means 27 shows the back cancellation means in action whereby the air cylinder 31 is withdrawn allowing the back cancellation means to lift up thereby cooperating with the back picker needle arm 29A and lifting it out of action so as to cancel the affect of placing the needles into memory thereby diverting freely at will the needle butt path to the normal path in contrast to the memory path.

Figure 20:
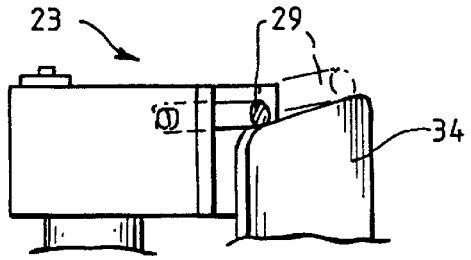
FIG. 20 shows the needle arm cam.

Referring to FIG. 20 a view in direction of arrow 20—20 of FIG. 18 shows the needle arm cam 34 which operates to place the picker needle arm 29A into the relevant position for normal operation.

In order to further assist the knitting machine a selection of so called "dummy" needles are prepared The dummy needles are standard needles modified by removal of the hook end. The placement of dummy needles into the knitting machine in selected positions assist the machine to function in a continuous manner throughout a number of functions without risking non-functional needles catching during threading.

In use the modified knitting machine of the invention can be brought into operation to perform the novel knitting method of the invention for construction of the improved footwear garment as previously described in one particularly preferred embodiment. The improved knitting machine can of course be applied to a wide variety of knitting operations and is not in any way limited to functioning in the manner only of producing the improved footwear garment of the invention.

In use the improved knitting machine of the invention provides a ready means of manufacturing an improved footwear garment, particularly in the manner of a highly efficient seamless and fully formed footwear garment as previously described.

A particularly preferred application of the improved knitting machine of the invention will now be described.

EXAMPLE 1

An improved footwear garment in the form of a ladies size with a medium gauge will use a cylinder 20 of 3¾ diameter with 188 needles. Of the 188 needles only 121 are functioning and the remaining 67 are incorporated without hooks and latches with a third of the top of the needle omitted in order to render the needle functionless on a high position (dummy needle). The sewing operation is commenced with a preparation of a chain program. Two moves of the chain program are commenced with needles being selected and forming stitches of elastic followed with one or more plain links which are determined in accordance with the quality width and length of the garment elastic braid 13. The elastic braid 13 is formed as an integral part of the knitting operation in accordance with the method of the invention. The braid is formed by the alternate cycles of the machine providing alternate one up, one down needle configurations at one turn and the needles being all at knitting height on the return cycle. The machine commences with three cycles of normal selection and then the selection changes and leaves unselected 13 needles on one side and 11 on the other side. By working 10 turns to the left and 10 turns to the right, the elastic braid 13 is finished in the form of a neatly prepared braid tapering down for commencement of the partial upper foot. Once the elastic braid is formed the preparation of the toe one 12 of the garment is commenced with the back pickers in action. The toe one section of the garment is formed with pick-up stitches, that is, stitches drawn up into memory, and with a progressive decreasing taking one needle per side off every second course of stitches and hold a stitch in memory to be reused when stitching is progressively increased in preparation of the toe two region. The preparation of the toe two region involves an increase of two stitches per course up until the partial upper foot region 5 is reached. Once the partial upper foot region 5 is reached all the functioning needles are forming a stitch and the dummy ones that are all at an elevated height do not function. The unique ability of the current invention to cancel the action of the pickers without interfering with the needles in any way in addition to the provision of dummy needles, allows the continuous and seamless production of the partial upper foot region from the toe region in addition to providing the ability of reducing or increasing the length of the fabric in the foot dependant on the number of courses and length required, again without interfering with the primary programming of the knitting machine. The novel method of the invention also provides the ability to produce the foot region of any required length. The heel region of the garment is produced by effectively reversing the operation of the toe and can again be prepared in a seamless fashion to produce an entire garment in one continuous operation. And by varying the length of the partial upper foot a range of garments of varying sizes can be produced

EXAMPLE 2

If the improved garment of the invention requires specific formation of a toe pocket this can be easily accomplished by using the back left pickers to pick up one stitch into memory cancelling one and the back right pickers picking up one and cancelling another and the front pickers picking down two from left, picking down two from right, cancelling two and accordingly working intermittent with the back pickers to allow the production of a double length of toe thereby forming a toe of a particular shape in accordance with the programming of the cancellation mechanisms. In the production of the heel region where a smaller heel pocket will be required the cancellation mechanism can be used to produce a slower reduction in the number of stitches thereby producing a smaller pocket.

In addition to the versatility of the modified knitting machine of the invention in the preparation of a heel and/or toe region of particular sizes and shapes as required the ability to cancel the front and back pickers without altering the programming of the machine allows the production of the partial upper foot region 5 to be exercised at will in order to produce a partial upper foot 5 of any length as is required in order to provide a range of garment sizes for various fittings. The unique ability of the invention to provide such a range of garment configurations provides clear advantages in manufacture not only in terms of efficiency but also in terms of the quality of the end product.

The invention can be seen to comprise a novel construction method and garment which is made up of various elements of sock design but placed together in quite a novel and inventive arrangement with the provision of an opening intermediate between the heel and the toe region which is quite distinct from the common sock design which places the opening in line with the heel and subsequent toe regions. The anatomy of this garment allows the use of conventional knitting machinery, albeit that such machinery of course must be adjusted and operated in a different sequence to allow the novel construction of the garment of the invention.

In constructing the garment, another aspect of the invention is the method of manufacture of the sock as previously described where the heel region of the garment is formed at the beginning of the construction with the stitching being performed to construct the heel one followed by the heel two section forming the heel pocket 1. The sole of the garment and partial upper foot are then formed followed by the toe one and toe two section finally resulting in the formation of the fully shaped garment. The garment is then finished by the elastic finishing of the heel top and toe top regions using conventional methods.

The method of manufacture may reverse the above described steps beginning with the toe region and moving across the sole to the heel region.

The garment of the invention can be manufactured out of a wide range of materials including normal pantyhose and sheer hosiery materials as are commonly used in the prior art garments or alternatively, the garment can be formed by any of the normal materials used in the weaving and knitting of socks in order to provide a more substantial garment for example; yarns, wool, cotton, natural and synthetics. The garment can be knitted in a selection of styles including plain and terry towelling. One clear advantage of the current invention is the provision of a fully shaped socklet or footlet which is not limited to the highly elastic material as is required by the prior art and can be constructed of any one of a range of materials or stitched in a very similar manner to the manufacture of a sock. The invention provides for the first time a footlet type garment which can be made out from a full range of yarn and knitting styles providing for the very first time such a garment made out of conventional sock materials which can provide full comfort, insulation, warmth and wearability.

In addition the invention provides an improved and highly versatile knitting machine. The claims form part of the disclosure in this application.

What is claimed is:

1. A sock type garment adapted for wearing on a wearer's foot including a sole, a partial upper foot, a heel and a toe wherein said heel and toe are shaped to assist accommodation of corresponding parts of the wearer's foot respectively, characterized in that an opening for insertion of the wearer's foot is provided intermediate of said heel and toe and wherein said garment is formed in one seamless knitted continuum to form one piece, and wherein said heel includes a heel one section formed by a picking up stitching and a heel two section formed by alternate picking up and picking down stitch with heel one and heel two sections being seamlessly and continuously joined and separated by a picking line so formed and a toe two section formed by alternate pick up and pick down stitching and a toe one section formed by pick up stitching with toe two and one sections being seamlessly and continuously joined and separated by a picking line so formed and both heel and toe seamlessly and continuously joined to said sole region.

2. A garment according to claim 1 wherein the regions of said heel and toe are shaped into pockets.

3. A garment according to claim 2 wherein said partial upper foot is elongate and formed adjacent said sole.

4. A garment according to claim 1 wherein said opening is formed across said heel top, toe top and partial upper foot.

5. A garment according to claim 1 wherein said heel one section is of sufficient size to substantially cover the wearer's heel and said toe one section is selected from a partial toe cover to a cover for the bulk of the wearer's upper foot.

6. A garment according to claim 1 constructed of any one or a combination of materials including yarns, wool, cotton, and spantex from natural and synthetic materials.

7. A sock type garment adapted for wearing on a wearer's foot including a sole, a partial upper foot, a heel and a toe wherein said heel and toe are shaped to assist accommodation of corresponding parts of the wearer's foot respectively characterized in that an opening for insertion of the wearer's foot is provided intermediate of said heel and toe, wherein said garment is formed in one seamless knitted continuum to form one piece, and wherein said opening has an elastic means fitted to said heel top and toe top region, and wherein said elastic means is knitted integrally with said garment, and wherein said elastic means is formed across the top regions of said toe and heel and tapers away along said partial upper foot.

8. A method of manufacturing a sock type garment adapted for wearing on a wearer's foot including a sole, a partial upper foot, a heel and a toe wherein said heel and toe are shaped to assist accommodation of corresponding parts of the wearer's foot respectively characterized in that an opening for insertion of the wearer's foot is provided intermediate of said heel and toe, wherein said garment is formed in one seamless knitted continuum to form one piece, and wherein said heel includes a heel one section formed by a picking up stitching and a heel two section formed by alternate picking up and picking down stitch with heel one and heel two sections being seamlessly and continuously joined and separated by a picking line so formed and a toe two section formed by alternate pick up and pick down stitching and a toe one section formed by pick up stitching with toe two and one sections being seamlessly and continuously joined and separated by a picking line so formed and both heel and toe seamlessly and continuously joined to said sole region, and including the use of a knitting machine to form the heel region of said garment beginning with the formation of the heel one section by pick up stitching then transferring to heel two section by alternate pick up and pick down stitching, the sole and upper partial foot one then formed continuous with said heel region followed by the formation of the toe two section by pick up and pick down stitching then transferring to toe one section by pick up stitching only.

9. A method according to claim 8 beginning with the toe region and finishing with the heel region.

10. A method according to claim 9 wherein said garment is finished by knitting a shaped elastic ridge over the heel and toe top region wherein said ridge is formed as an integral part of the knitting of the garment with transfer needle selection only.

11. A method of manufacture according to claim 8 including the use of a knitting machine wherein the toe one section of the garment is formed with the back pickers of said machine in action and by selective cancellation of said back pickers so as to form the required number of pick up stitches with a progressive decrease, the toe two section of the garment is then formed continuously therewith with the front pickers of said machine in action and by selective cancellation returning selective needles held in memory providing an alternate preparation of stitching progressively adding rows until the toe region is fully shaped and formed, the back pickers and front pickers are then cancelled to form the partial upper foot and sole as a continuum of the toe region, when the partial upper foot and sole is of sufficient length the back pickers are brought into action to selectively place needles in memory providing stitches in a progressive decrease to form the heel two section, the front pickers then activate with selective cancellation to form progressive stitching to form a heel region wherein said toe region, foot and sole and heel region are formed as one continuous and seamless operation.

12. A method of manufacture according to claim 11 wherein said machine is provided with a number of dummy needles.

13. A knitting machine including a rotatable cylinder having mounted a series of closely spaced needles located in annular slots, said machine being provided with needle knitting cams and at least one back picker for placing selected needles into memory, at least one front picker for returning needles from memory characterized in having cancellation means to selectively cancel the function of said back picker and said front picker within a cycle.

14. A knitting machine according to claim 13 wherein a back cancellation means is provided to cancel the function of said back picker and a front cancellation means is provided to cancel the function of said front picker.

15. A knitting machine according to claim 14 wherein said back cancellation means acts by lifting the picker needle arm of said back picker away from interaction with said needles.

16. A knitting machine according to claim 14 wherein said front cancellation means acts by lowering the picker needle arm of said front picker away from interaction with said needles.

17. A knitting machine according to claim 13 including a selection of dummy needles.

18. A knitting machine according to claim 13 including a programmable switching means for controlling the function of said cancellation means.

19. A knitting machine including a rotatable cylinder having mounted a series of closely spaced needles located in annular slots, said machine being provided with needle knitting cams and at least one back picker for placing selected needles into memory, at least one front picker for returning needles from memory characterized in having cancellation means to selectively cancel the function of said back picker or said front picker within a cycle.

* * * * *